United States Patent [19]

Glennon et al.

[11] Patent Number: 4,772,802

[45] Date of Patent: Sep. 20, 1988

[54] STARTING/GENERATING SYSTEM

[75] Inventors: Timothy F. Glennon; Richard W. Reynolds; Wayne A. Flygare; Paul Baits; Ogbonna C. Wambu, all of Rockford, Ill.

[73] Assignee: Sundstrand Corporation, Rockford, Ill.

[21] Appl. No.: 87,129

[22] Filed: Aug. 19, 1987

[51] Int. Cl.[4] ..... F02N 11/08

[52] U.S. Cl. ..... 290/31; 290/46

[58] Field of Search ..... 290/22, 31, 46; 322/10

[56] References Cited

U.S. PATENT DOCUMENTS

| | | | |
|---|---|---|---|
| 3,786,696 | 1/1974 | Aleem | 74/687 |
| 3,902,073 | 8/1975 | Lafuze | 290/46 |
| 3,908,130 | 9/1975 | Lafuze | 290/46 |
| 3,908,161 | 9/1975 | Messenger | 322/29 |
| 3,937,974 | 2/1976 | Lafuze | 290/46 |
| 4,093,869 | 6/1978 | Hoffman et al. | 290/31 |
| 4,315,442 | 2/1982 | Cordner | 74/687 |
| 4,330,743 | 5/1982 | Glennon | 290/46 |
| 4,467,267 | 8/1984 | Hucker et al. | 322/61 |
| 4,481,459 | 11/1984 | Mehl et al. | 322/10 |
| 4,616,166 | 10/1986 | Cooper et al. | 290/31 X |

*Primary Examiner*—William M. Shoop, Jr.
*Assistant Examiner*—W. E. Duncanson, Jr.
*Attorney, Agent, or Firm*—Wood, Dalton, Phillips, Mason & Rowe

[57] ABSTRACT

Prior starting/generating systems which operate a generator as a motor to start a prime mover have been inefficient since motive power was delivered to the prime mover through hydrostatic trim and differential components of a constant speed drive interposed between the prime mover and the generator. In order to overcome this problem, means are provided between the prime mover and the generator for bypassing these components of the constant speed drive when operating in a starting mode so that motive power is transferred directly to the prime mover. This, coupled with the fact that the generator is operated as a motor responsive to generator speed and/or generator power factor, increases the efficiency of the system when in the starting mode.

9 Claims, 3 Drawing Sheets

STARTING/GENERATING SYSTEM

FIELD OF THE INVENTION

The present invention relates generally to starting-/generating systems comprising a prime mover coupled to a generator by a drive mechanism, and more particularly to a system for efficiently operating the generator as a motor to start the prime mover.

BACKGROUND

Prior systems have been devised wherein a generator is operated as a motor to develop motive power which is transferred to a prime mover to start same, thus obviating the necessity of a dedicated starter motor or other starting apparatus For example, Cordner U.S. Pat. No. 4,315,442, assigned to the assignee of the instant application, discloses such a system wherein motive power developed by the generator is transferred through a constant speed drive to start the prime mover. A similar system is disclosed in Aleem U.S. Pat. No. 3,786,696. In the former system the power is transferred to the prime mover through a differential of the constant speed drive whereas in the latter motive power developed by the generator is transferred through one of the hydraulic units of the constant speed drive to the prime mover. In both types of systems, inefficiencies are encountered owing to the transfer of power through mechanical or hydraulic components. Also, a failure or malfunction of the constant speed drive can prevent starting of the prime mover by the generator.

Hoffmann et al. U.S. Pat. No. 4,093,869 discloses a method and apparatus for starting a prime mover using a brushless synchronous dynamoelectric machine. The machine includes an exciter having a direct axis field winding which is provided power during operation in a generating mode to in turn provide excitation for a main generator. The exciter also includes a quadrature axis winding which receives AC power during operation in a starting mode so that excitation is available for the main generator even when rotor speed is at zero. During operation in the starting mode, the stator windings of the main generator are provided AC power so that the main generator and the prime mover are accelerated from standstill up to prime mover self-sustaining speed.

A further type of starting/generating system and method is disclosed in Mehl et al. U.S. Pat. No. 4,481,459, assigned to the assignee of the instant application. This system includes a prime mover which is connected to a brushless generator by a torque converter. During operation in the starting mode, the torque converter is deactuated to decouple the brushless generator from the prime mover and a permanent magnet generator of the brushless generator is provided power at increasing voltage and frequency to accelerate the rotor of the generator. Once a particular speed is reached, power is applied to the exciter and main generator of the brushless generator so that the brushless generator is operated as a motor. Thereafter, the torque converter is actuated so that the motive power developed by the brushless generator is transferred to the prime mover to start same.

Messenger U.S. Pat. No. 3,908,161, discloses a generating system wherein a three-phase alternating voltage is applied to a set of exciter field windings which are connected in a wye configuration. The exciter operates as a rotating transformer, with the armature current of the exciter being rectified and applied to the field winding of the main generator to cause the main generator to operate as a motor and thereby start a prime mover. Once the prime mover has been started, the rotating transformer is converted back to a brushless exciter by changing the connection of the exciter field windings and applying a DC voltage thereto from the output of a permanent magnet generator, or PMG.

Other patents which disclose systems similar to the Messenger device include Lafuze U.S. Pat. Nos. 3,902,073, 3,908,130 and 3,937,974.

A further device which eliminates the necessity for a starter motor is disclosed in Glennon U.S. Pat. No. 4,330,743, assigned to the assignee of the instant application. A reversible AC to DC converter receives external DC power and supplies AC power to drive an alternator as a motor to start a prime mover connected thereto.

Except for the systems disclosed in the Cordner and Aleem patents, in each of the foregoing systems, there is no use made of a constant speed drive connected between the prime mover and the generator. Therefore, these systems do not encounter the problems and inefficiencies associated with starting a prime mover using a generator which is coupled thereto by a constant speed drive.

Hucker et al. U.S. Pat. No. 4,467,267, also assigned to the assignee of the instant application, discloses an alternator excitation system which includes a brushless generator coupled to a prime mover by a constant speed drive. The brushless generator includes separate or integral DC and AC exciters which develop excitation currents which are summed and applied to a field winding of a main generator. The DC exciter includes a field winding which receives DC power provided by a PMG, a rectifier and a voltage regulator while the AC exciter includes a set of field windings which are connected in series with armature windings of the main generator. There is no disclosure, however, that the brushless generator may be operated as a motor to start the prime mover.

Cook U.S. patent application Ser. No. 886,874, filed July 18, 1986, entitled "Inverter Operated Turbine Engine Starting System" and assigned to the assignee of the instant application suggests that a generator coupled to an aircraft engine by a constant speed drive may be used to start the engine provided that additional mechanical components are used to permit the constant speed drive to be operated in reverse or bypassed entirely. These additional components, however, are said to add to the size and weight of the aircraft and may increase aerodynamic drag. Further, no structure is disclosed or suggested to accomplish either result.

SUMMARY OF THE INVENTION

In accordance with the present invention, a starting-/generating system includes a generator which is operable in a starting mode as a motor to develop motive power which is transferred directly to the prime mover to start same without transferring power through hydrostatic trim and differential components of a constant speed drive connected therebetween.

More particularly, an improvement in a starting-/generating system including a prime mover, a generator having a main generator portion and an exciter portion and a constant speed drive (CSD) having hydrostatic trim and differential components coupled between the prime mover and the generator includes first means operable in a starting mode for providing AC power to the exciter portion, second means operable in the starting mode for providing AC power to armature windings of the main generator portion once the field winding has been provided excitation to cause the generator to operate as a motor and means disposed in the CSD and coupled between the generator and the prime mover for bypassing the hydrostatic trim and differential components of the CSD when in the starting mode so that motive power developed by the generator is transferred directly to the prime mover.

In the preferred embodiment of the invention, the bypassing means comprises a pair of overrunning clutches. One of the overrunning clutches is coupled between the differential component of the CSD and the generator and is capable of transferring motive power in one direction only from the prime mover to the generator when operating in a generating mode. The other overrunning clutch is coupled between the generator and the prime mover across the hydrostatic trim and differential components and is capable of transferring motive power in one direction only from the generator to the prime mover when in the starting mode.

In order to further increase efficiency, means are provided for varying the current delivered to the exciter portion as a function of generator speed and/or generator power factor. This results in optimal operation of the generator as a motor in the starting mode.

The starting/generating system of the present invention does not transfer motive power through the constant speed drive, and hence the inefficiencies encountered in the prior art are avoided. Further, the bypassing means are disposed within the CSD itself, thus resulting in only a marginal increase in size and weight in order to accomplish the starting function.

DESCRIPTION OF THE PREFERRED EMBODIMENT

Figure 1:
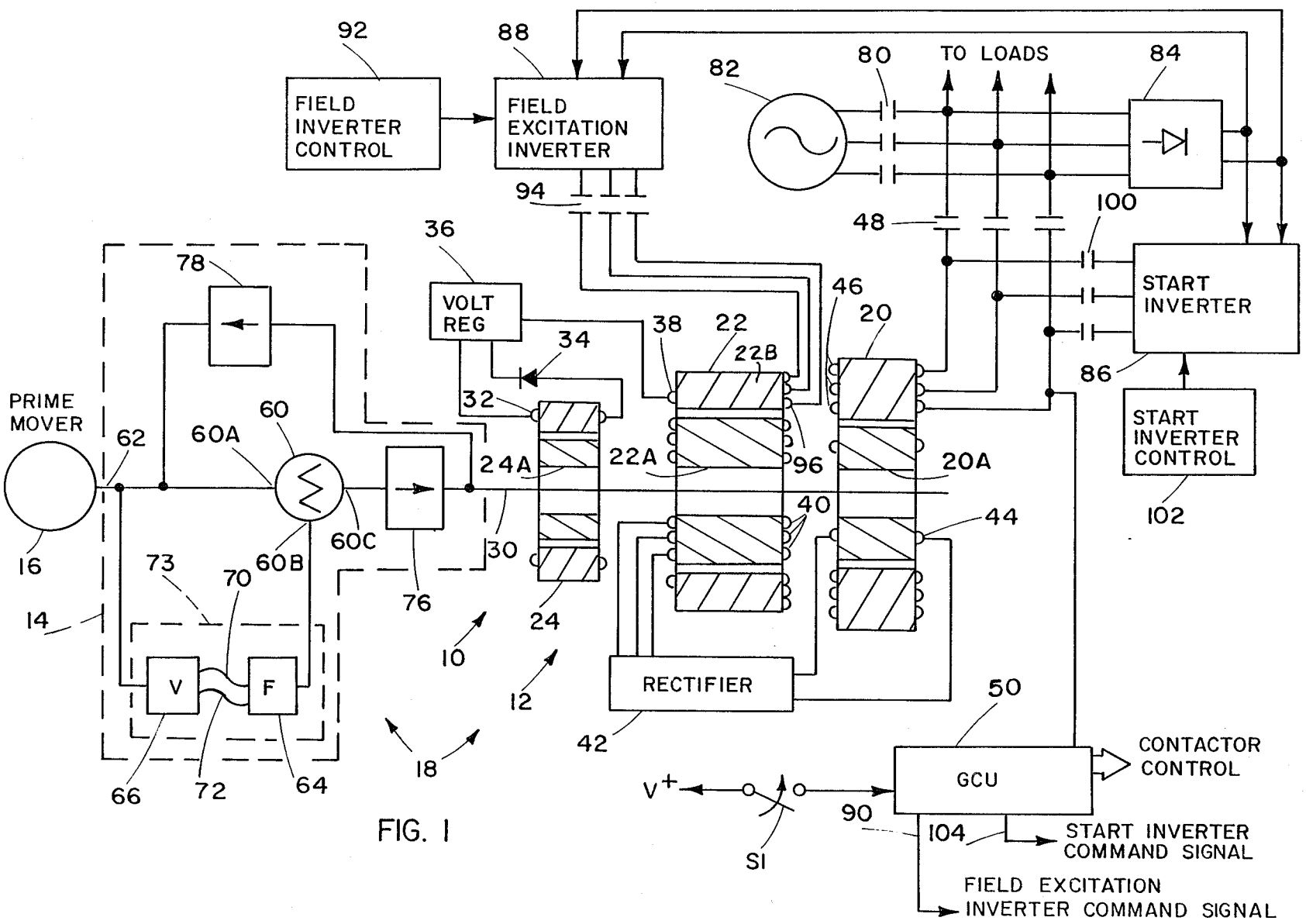
FIG. 1 is a simplified block diagram of the starting-/generating system of the present invention.

Referring now to FIG. 1, there is illustrated a starting/generating system 10 according to the present invention. This system comprises a three-phase synchronous brushless generator 12 which is connected by a constant speed drive (CSD) 14 to a variable speed prime mover 16. The prime mover 16 may comprise, for example, an aircraft jet engine. The generator 12 and constant speed drive 14 may be contained in a unitary housing and are sometimes together referred to as an integrated drive generator (IDG) 18.

The brushless generator 12 includes a main generator portion 20, an exciter portion 22 and a permanent magnet generator, or PMG 24. The main generator portion 20 exciter portion 22 and PMG 24 include rotor portions 20A, 22A, and 24A, respectively, which are mounted on a common shaft 30 and which together comprise a common rotor of the brushless generator 12.

In a generating mode, rotation of the shaft 30 and rotor portion 24A of the PMG 24 induces a voltage in an armature winding 32 which is rectified by a rectifier 34. A voltage regulator 36 receives the rectified voltage and delivers a controlled field current to a DC field winding 38 of the exciter portion 22. While operating in a generating mode of operation during which AC power is developed by the brushless generator 12, the voltage regulator 36 may be responsive to one or more operating parameters, such as output voltage, output current and the like. Inasmuch as the details of the voltage regulator 36 are not essential to an understanding of the present invention, it will not be described specifically herein.

Rotation of the shaft 30 while current is flowing in the DC field winding 38 in turn induces voltages in three-phase armature windings 40 of the exciter portion 22 which are rectified by a rectifier circuit 42. The rectified voltage is applied to a field winding 44 of the main generator portion 20. Current in the field winding 44 in turn induces a magnetic field in space occupied by a set of main generator armature windings. Rotation of the shaft 30 causes a voltage to be developed in the armature windings 46 which is coupled through contactors 48 to one or more loads. The open/closed status of the contactors 48 is in turn controlled by a generator control unit, or GCU 50.

In order to obtain a constant frequency output from the generator 12, it is necessary to rotate the shaft 30 at a constant speed. The CSD 14 is employed to convert the variable speed output of the prime mover 16 into constant speed motive power for driving the shaft 30. The CSD 14 includes a mechanical differential component 60 having a first input 60A coupled to the output shaft 62 of the prime mover 16 through a normally-closed manual disconnect mechanism 63 and a second input 60B which is coupled to an output shaft of a fixed-displacement hydraulic unit 64. A further, variable-displacement hydraulic unit 66 includes a shaft which is coupled to the output shaft 62 of the prime mover 16 through the disconnect mechanism 63. The units 64, 66 are hydraulically interconnected by fluid lines 70, 72 to permit fluid flow between the units 64, 66. The units 64, 66 comprise hydrostatic trim components 73 of the CSD 14.

The displacement of the variable displacement unit 66 is controlled by a hydraulic control (not shown) to cause the fixed-displacement unit 64 to develop compensating speed which is added to or subtracted from the speed of the prime mover output shaft 62 by the differential component 60 so that the shaft 30 is driven at a constant speed. The constant speed drive 14 may be of the type disclosed in Baits U.S. Pat. No. 3,576,143, assigned to the assignee of the present invention and the disclosure of which is hereby incorporated by reference. As noted in greater detail hereinafter, the constant speed drive 14 is modified by the addition of first and second overrunning clutches 76, 78.

When it is desired to start the prime mover 16 using the main generator 12, a start switch S1 is closed, in turn coupling a high state signal to the GCU 50. In rsponse to this start signal, the GCU 50 opens the contactors 48 and closes a set of contactors 80 so that an external source of AC power 82 is coupled to a rectifier circuit 84. The rectifier circuit 84 in turn provides DC power to a start inverter 86 and a field excitation inverter 88. At this time, a field inverter control 92 receives an enable signal over a line 90 from the GCU 50 which in turn operates the inverter 88 to develop three-phase AC power. This polyphase AC power is coupled through closed contactors 94 to a set of three AC field windings 96 which are disposed with the DC field winding in a common stator 22B of the exciter portion 22. The contactors 94 are also controlled by the GCU 50.

In order to couple energy across the airgap of the exciter 22, a relative frequency must exist between the exciter field and the exciter armature. In the generating mode, this is done by physically rotating the armature windings 40 in a fixed field provided by the voltage regulator 36. In the starting mode at zero speed and during acceleration of the shaft 30, this relative frequency is provided by the field excitation inverter 88 which supplies AC current to the AC field windings 96. The AC current flowing in the field windings 96 induces voltages in the armature windings 40 which are in turn rectified by the rectifier 42 to produce DC power which is coupled to the field winding 44 of the main generator 20. Thus, the main generator 20 receives excitation even at zero shaft speed. After a short time following closure of the contactors 80 and 94 sufficient to ensure that excitation has been applied to the field winding 44, the GCU 50 closes a set of contactors 100 and provides an enable signal over a line 104 so that AC power is developed by the start inverter 86 under control of a start inverter control circuit 102. This AC power is provided to the armature windings 46 of the main generator 20. The output voltage and frequency of the start inverter 86 are increased with the speed of the shaft 30 so that the main generator 20 accelerates as a synchronous motor to in turn accelerate the shaft 30. In addition, the field inverter control 92 controls the field excitation inverter 88 to vary the field current provided to the AC field windings 96 as a function of shaft speed and/or generator power factor. As noted in greater detail hereinafter, the field inverter control 92 and the start inverter control 102 may be responsive to one or more parameters so that the main generator 20 is efficiently operated as a motor during this time.

The overrunning clutches 76, 78 cause the motive power developed at the shaft 30 to bypass the differential component 60 and hydrostatic trim components 73 of the CSD 14. The first overrunning clutch 76 is connected between an output 60C of the differential component 60 and the shaft 30. The first overrunning clutch 76 is capable of transferring power in one direction only from the differential component 60 (and thus the prime mover 16) to the brushless generator 12. The second overrunning clutch 78 is connected between the shaft 30 and the prime mover output shaft 62 across the combination of the differential component 60 and the hydrostatic trim components 73 and is capable of transferring motive power in one direction only from the brushless generator 12 to the prime mover 16. as should be evident to one skilled in the art, the first and second overrunning clutches 76, 78 together comprise means for bypassing the differential and hydrostatic trim components 60, 73 of the constant speed drive 14 when in the starting mode so that motive power developed by the main generator 20 is transferred directly to the prime mover 16 to start same.

A key advantage brought about by the structural arrangement of the overrunning clutches in the CSD 14 resides in the fact that the CSD size and weight are not increased significantly in order to accommodate the high torques involved in the starting mode of operation.

It should be noted that the present invention may alternatively be used to "motor" the prime mover 16 without actually starting same to check the condition of pumps or other devices normally driven by the prime mover. Thus, the system is operable in an "engine assist mode" in which the prime mover 16 is started or motored.

Of course, when operating in the generating mode, the overrunning clutch 78 prevents the prime mover 16 from directly driving the brushless generator 12. Instead, the constant speed drive 14 converts the variable speed motive power developed by the prime mover 16 into constant speed motive power which is transmitted by the overrunning clutch 76 to the brushless generator 12.

Figure 2:
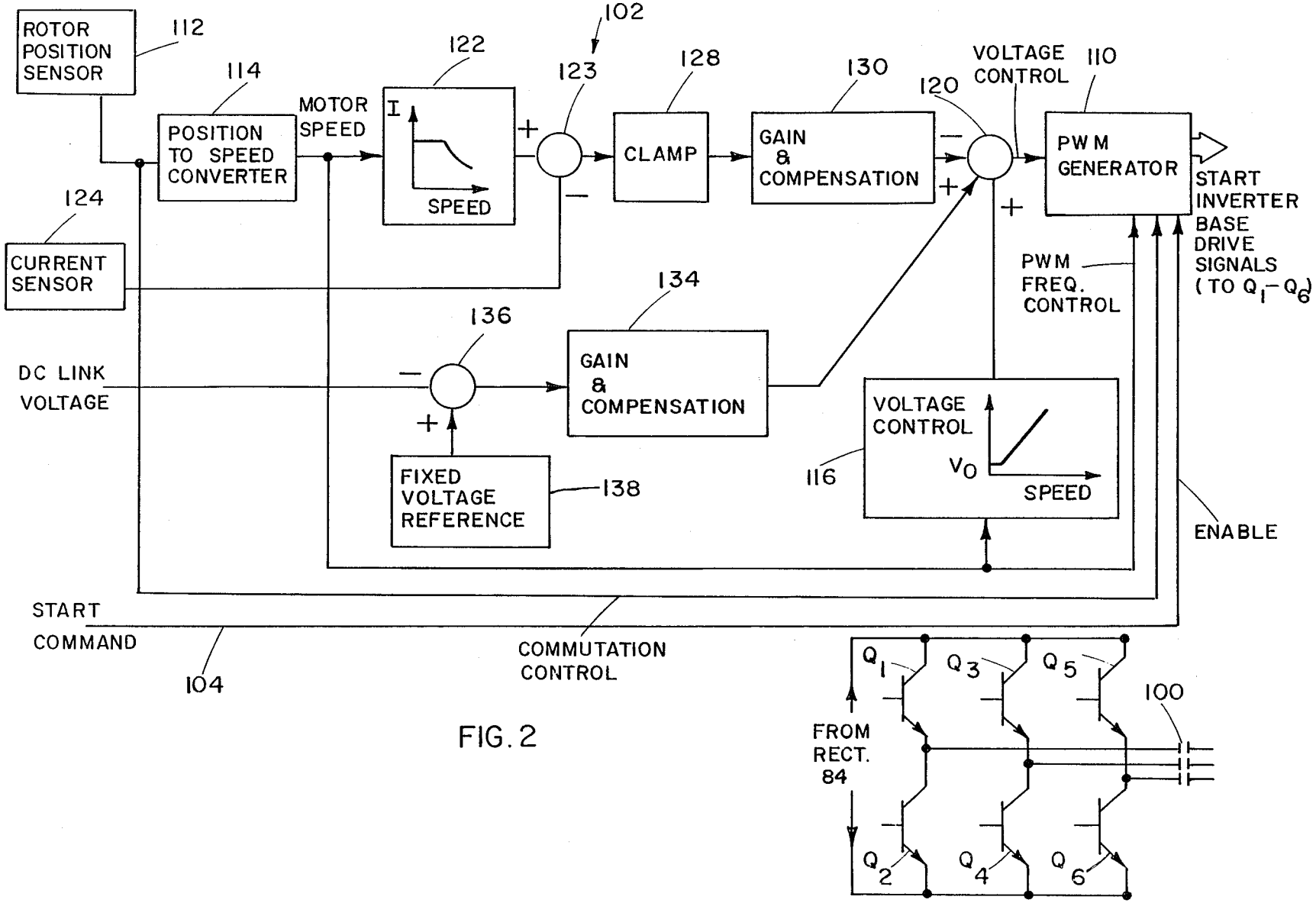
FIG. 2 is a block diagram of the start inverter illustrated in block diagram form in FIG. 1.

Referring now to FIG. 2, there is illustrated in block diagram form the start inverter control circuit 102. The control circuit 102 develops pulse width modulated (PWM) base drive signals for each of six inverter switches Q1–Q6 which are connected in a typical inverter bridge configuration. A PWM generator 110 is primarily responsive to the speed of the shaft 30, as detected by a rotor position sensor 112 and a position-to-speed converter 114. A function generator 116 receives the output of the position-to-speed converter 114 representing motor speed and causes the PWM generator 110 to control the inverter switches so that the start inverter 86 output voltage begins at a predetermined value $V_o$ and approximately linearly increases with the speed of the shaft 30. In addition, the output frequency of the start inverter 86 is also controlled as a function of rotor speed so that a substantially constant voltage-to-frequency (V/F) ratio is maintained in the inverter 86 output.

The rotor position signal developed by the sensor 112 comprises a commutation control input for controlling commutation of the armature windings 46 while the speed signal from the converter 114 determines the PWM frequency.

The voltage control of the inverter 86 may be modified by signals coupled to a summing junction 120. The signal from the circuit 114 representing motor speed is passed through a transfer function circuit 122 which in turn develops a signal representing the maximum allowable current in the armature windings 46 of the main generator 20 as a function of speed of the shaft 30. This signal is summed by a summing junction 123 with a signal representing the actual current in the armature winding 46 as detected by a motor current sensor 124. The resulting error signal is limited by a clamp circuit 128, modified by a gain and compensation circuit 130 and applied to an inverting input of the summing junction 120. This portion of the control limits the maximum torque developed by the generator 20 in the starting mode.

A further signal is coupled to a non-inverting input of the summing junction 120 by a gain and compensation circuit 134 which modifies the output of a further summing junction 136. The summing junction 136 develops an error signal representing the deviation of the output voltage of the rectifier circuit 84 (FIG. 1) from a fixed voltage reference provided by a reference signal generator 138. This portion of the control compensates for variations in the output voltage from the rectifier circuit 84.

Figure 3:
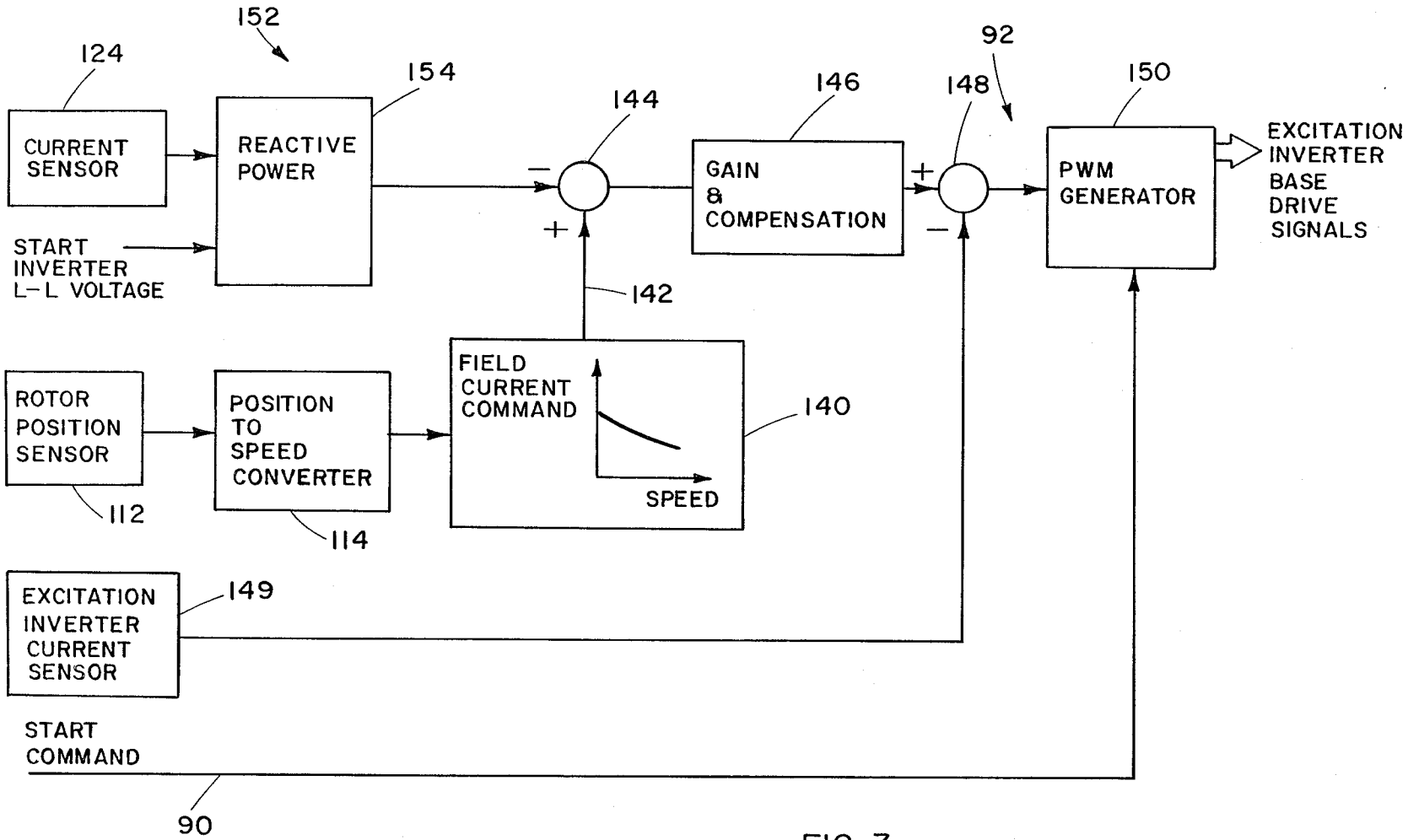
FIG. 3 is a block diagram of the field excitation inverter control shown in block diagram form in FIG. 1.

Referring now to FIG. 3, there is illustrated in block diagram form the field inverter control 92 which controls the field excitation inverter 88. The inverter 88 is identical to that shown in simplified form in FIG. 2 comprising the switches Q1–Q6 connected in a bridge configuration. The circuit 92 is primarily responsive to the speed of the shaft 30, as detected by the rotor position sensor 112 and the position-to-speed converter 114.

A transfer function circuit 140 develops a field current command signal on a line 142 representing the field current to be applied to the AC field windings 96 as a function of speed of the shaft 30. While the schedule illustrated in the block representing the circuit 140 denotes gradually decreasing field current as a function of rotor speed, it should be noted that the relationship between field current command signal and rotor speed may be different, if desired.

The field current command on the line 142 is coupled to a non-inverting input of a summing junction 144. The summing junction 144 includes an output which is coupled by a gain and compensation circuit 146 to a non-inverting input of a further summing junction 148. The summing junction 148 includes an inverting input which receives a signal representing the output current of the excitation inverter as developed by a current sensor 149 and develops an error signal which in turn controls a PWM generator 150. The generator 150 develops PWM base drive signals for the switches in the inverter 88. The generator 150 is enabled by the start command signal developed by the GCU 50 on the line 90.

The signal coupled to the non-inverting input of the summing junction 148 may be modified by a generator power factor sensing circuit 152. The circuit 152 includes the current sensor 124 which senses the input current to the armature windings 46 of the main generator 20 and a circuit 154 which receives the output of the current sensor 124 and the voltage across two of the outputs of the start inverter 86 and develops a signal representing the reactive power applied to the generator 20. This signal is coupled to an inverting input of the summing junction 144 and controls the current developed by the excitation inverter 88 in accordance with the generator power factor so that the generator is always operated at near unity power factor during varying output load conditions. This minimizes start inverter current and losses.

To summarize operation of the system in the starting mode, excitation is provided to the main generator field winding 44 by the field excitation inverter 88, the exciter 22 and the rectifier 42 and AC power is provided to the main generator armature by the start inverter 86. High torque levels are thus produced at zero and low speeds. In the preferred embodiment, the field current provided to the exciter field winding 96 is controlled in accordance with generator speed and power factor so that the generator 20 power factor is maintained near unity. The prime mover 16 is therefore accelerated up to self-sustaining speed.

The GCU 50 senses one phase of the main generator armature voltage to determine when the generator has reached a predetermined speed corresponding to the self-sustaining speed of the prime mover 16. Once this condition is sensed, the contactors 80, 94 and 100 are opened, the contactors 48 are closed and the inverter controls 92, 102 are disabled by the GCU 50 so that normal generating mode operation then commences. Since both inverters 86 and 88 need be operable only in the engine assist mode, they are only used infrequently and for relatively short periods of time. Hence, these inverters are less subject to malfunction and result in a highly reliable start function.

In the preferred embodiment, one or both of the inverters are cooled by a cooling system described and claimed in Niggemann, U.S. patent application Ser. No. 087,126, filed Aug. 19, 1987, entitled "Heat Exchanger Apparatus for Electrical Components", assigned to the assignee of the present application and the disclosure of which is hereby incorporated by reference. The generator is cooled by the cooling system already present in the IDG when operating in the start mode. Thus, no additional cooling systems are required to implement this function except that noted above.

In addition, while the exciter 22, is illustrated in FIG. 1 as being a unitary structure with AC and DC field windings, it should be noted that this exciter may be replaced by separate AC and DC exciters, if desired.

As should be evident from the foregoing discussion, the system of the present invention is capable of being operated in a normal generating mode to develop AC power for one or more loads and may be operated in a starting mode to start the prime mover 16 without the necessity of a dedicated starter motor and without encountering the inefficiencies and problems associated with prior starting systems. Further, the overrunning clutches 76, 78 do not add significantly to the size and weight of the IDG 18, and hence the starting function is obtained with little penalty. In addition, the prime mover 16 may be started by the generator 20 even if a fault in the CSD 14 or another occurrence has resulted in actuation of the disconnect mechanism 63.

We claim:

1. In a starting/generating system including a prime mover, a generator having a main generator portion and an exciter portion for providing excitation to a field winding of the main generator portion and a constant speed drive (CSD) having hydrostatic trim and differential components coupled between the prime mover and the generator, the system being operable in a starting mode in which motive power developed by the generator is delivered to the prime mover to start same and in a generating mode in which motive power developed by the prime mover is delivered to the generator so that the generator develops electrical power, the improvement comprising:

first means operable in the starting mode for providing AC power to the exciter portion;

second means operable in the starting mode for providing AC power to armature windings of the main generator portion to cause the generator to operate as a motor; and means coupled between the generator and the prime mover for bypassing the hydrostatic trim and differential components of the CSD when in the starting mode so that motive power developed by the generator is transferred directly to the prime mover.

2. The improvement of claim 1, wherein the bypassing means comprises a pair of overrunning clutches.

3. The improvement of claim 2, wherein one of the overrunning clutches is coupled in series with the differential component of the CSD and is capable of transferring motive power in one direction only from the prime mover to the generator and wherein the other overrunning clutch is coupled across the series combination of the differential component and the one overrunning clutch and is capable of transferring motive power in one direction only from the generator to the prime mover.

4. The improvement of claim 1, wherein the first providing means includes means for varying the current delivered to the exciter portion as a function of generator speed.

5. The improvement of claim 1, wherein the first providing means includes means for varying the current delivered to the exciter portion as a function of generator power factor.

6. The improvement of claim 1, wherein the generator exhibits a power factor and wherein the first providing means includes means for varying the current delivered to the exciter portion to maintain the generator power factor substantially at unity during operation in the starting mode.

7. The improvement of claim 1, wherein the second providing means includes means for increasing the voltage and frequency of the AC power applied to the armature windings over time to accelerate the generator in the starting mode.

8. The improvement of claim 1, wherein the second providing means includes means for limiting the maximum torque developed by the generator in the starting mode.

9. In an aircraft having an engine and a brushless generator with a rotor driven by said engine, the generator having an exciter field winding and a generator armature winding and a generator field winding disposed on the rotor and a rectifer connecting the exciter armature winding with the generator field winding, a method of starting the engine, comprising:

applying AC excitation current to the exciter field winding to induce an AC voltage in the exciter armature winding which is rectified by the rectifier to develop a DC current in the generator field winding;

applying AC starting power at a particular voltage and frequency to the generator armature winding:

increasing the starting power voltage and frequency as a function of rotor speed to accelerate the rotor and drive the engine to starting speed; and varying the AC excitation current as a function of rotor speed during engine starting so that the generator operates near unity power factor.

* * * * *